US005226396A

United States Patent [19]

Bailey

[11] Patent Number: 5,226,396

[45] Date of Patent: Jul. 13, 1993

[54] MEASURING-SIGNALING APPARATUS FOR A MULTI-FUEL SYSTEM OF AN ENGINE

[75] Inventor: John M. Bailey, Dunlap, Ill.

[73] Assignee: Caterpillar Inc., Peoria, Ill.

[21] Appl. No.: 947,876

[22] Filed: Sep. 21, 1992

[51] Int. Cl.[5] ..... F02M 51/00; F02B 75/12

[52] U.S. Cl. ..... 123/494; 123/1 A; 123/575; 123/704

[58] Field of Search ..... 123/1 A, 494, 703, 704, 123/575; 422/80

[56] References Cited

U.S. PATENT DOCUMENTS

| | | | |
|---|---|---|---|
| 3,582,281 | 6/1971 | Fenske et al. | 422/80 |
| 3,750,635 | 8/1973 | Hoffman et al. | 123/140 MC |
| 3,768,368 | 10/1973 | Krauja et al. | 91/378 |
| 4,052,970 | 10/1977 | Niertit et al. | 123/445 |
| 4,096,839 | 6/1978 | Niertit | 123/704 |
| 4,222,713 | 9/1980 | Dekeyser | 417/214 |
| 4,328,780 | 5/1982 | Andrew | 60/276 |
| 4,412,444 | 11/1983 | Ketel, II | 73/23 |
| 4,686,951 | 8/1987 | Snyder | 123/704 |
| 4,706,629 | 11/1987 | Wineland et al. | 123/494 |
| 5,014,670 | 5/1991 | Mitsumoto | 123/494 |
| 5,060,619 | 10/1991 | Sakurai et al. | 123/494 |
| 5,159,898 | 11/1992 | Hartel et al. | 123/1 A |

FOREIGN PATENT DOCUMENTS

| | | | |
|---|---|---|---|
| 0478985 | 4/1992 | European Pat. Off. | 123/1 A |
| 0480179 | 4/1992 | European Pat. Off. | 123/1 A |

*Primary Examiner*—E. Rollins Cross
*Assistant Examiner*—Erick Solis
*Attorney, Agent, or Firm*—Frank L. Hart

[57] ABSTRACT

This invention relates to apparatus for determining the energy content of a fuel and delivering an engine controlling signal responsive to the determined energy content.

14 Claims, 3 Drawing Sheets

MEASURING-SIGNALING APPARATUS FOR A MULTI-FUEL SYSTEM OF AN ENGINE

TECHNICAL FIELD

This invention relates generally to apparatus for determining the energy content of a fuel and delivering an engine controlling signal responsive to said determination.

BACKGROUND ART

In the operation of multi-fuel systems for engines, it is necessary to identify the fuel being used and then appropriately change the volume of fuel entering the combustion chambers and the timing of the engine. Examples of such fuel systems are set forth in U.S. Pat. No. 4,222,713 which issued on Sep. 16, 1980 to Richard A. DeKeyser et al, U.S. Pat. No. 3,768,368 which issued on Oct. 30, 1973 to Ziedonis I. Krauja et al, U.S. Pat. No. 4,412,444 which issued on Nov. 1, 1983 to William E. Ketel, and U.S. Pat. No. 3,750,635 which issued on Aug. 7, 1973 to John L. Hoffman et al.

Each of these previous inventions have one or more problems of being excessively complex, not adapted to the control of fuels having widely differing properties, and other problems which are solved by the invention of this document.

DISCLOSURE OF THE INVENTION

In one aspect of the invention a measuring-signaling apparatus is provided for a multi-fuel system of an engine which has a fuel conduit. A mixing chamber has an inlet and an outlet and is connected to apparatus for delivering a constant mass flow rate of air into the mixing chamber and a metering pump which is connectable to the fuel conduit. A system is provided for burning the fluid from the mixing chamber and discharging resultant gasses. Analysis apparatus is provided for measuring the oxygen content of the resultant gasses and delivering a responsive signal S-1. A first controller is adapted to receive signal S-1 and automatically adjust the volume output of the metering pump in response to signal S-1 for maintaining stoichiometric burning of the fluid mixture. The volumetric output of the metering pump is measured and a responsive signal S-2 is delivered. A second controller is adapted to receive signal S-2 and deliver a responsive signal S-3 for controlling the operation of the engine.

BEST MODE FOR CARRYING OUT THE INVENTION

Figure 1:
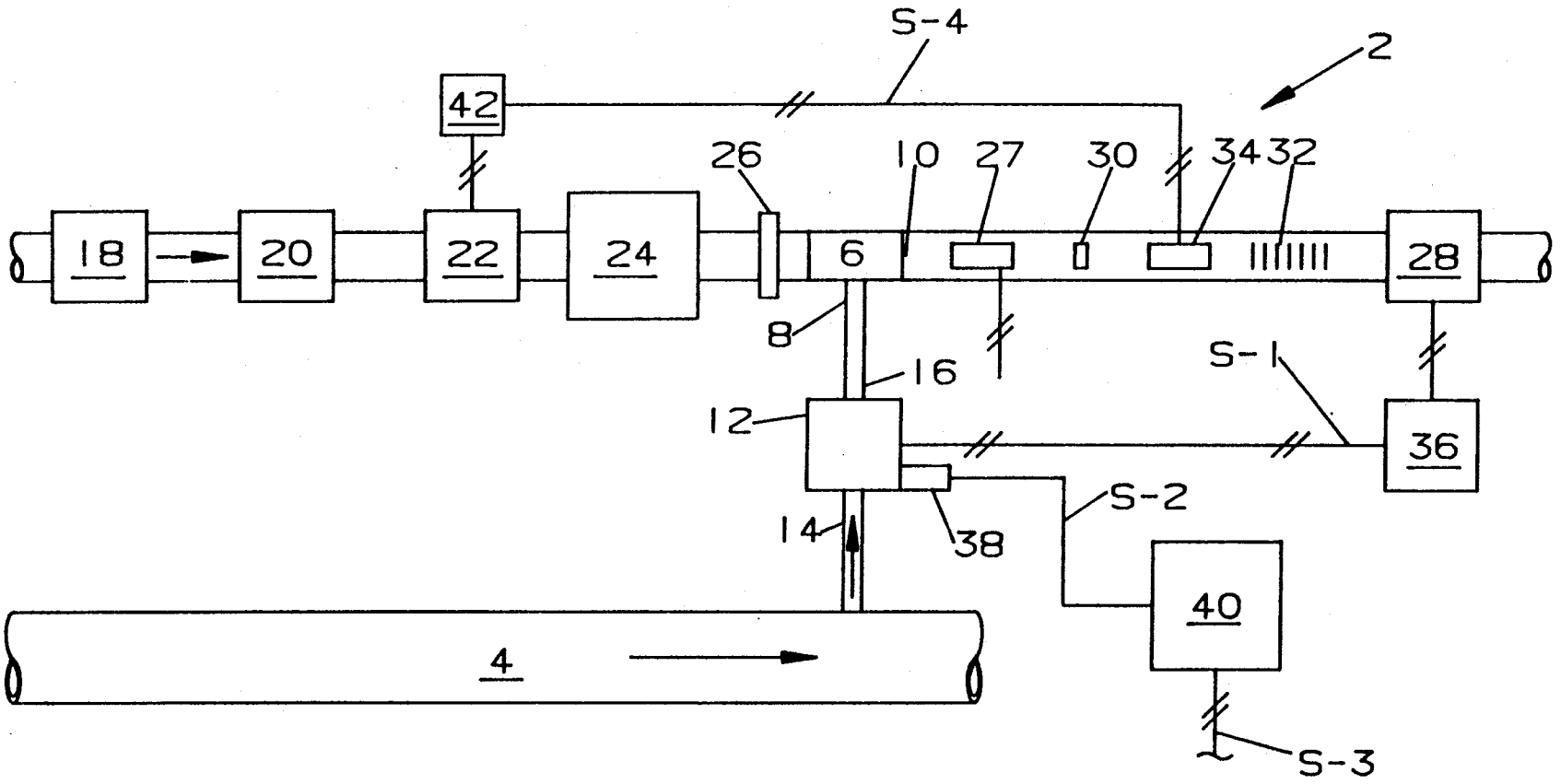
FIG. 1 is a diagrammatic view of the apparatus of this invention.

Referring to the preferred embodiment of this invention, as shown in FIG. 1, the apparatus 2 of this invention is connectable to the fuel conduit 4 which supplies fuel to the engine (not shown) having a multi-fuel system.

A mixing chamber 6 of the apparatus 2 has an inlet 8 and an outlet 10. The inlet 8 is connected to a means 12 for controllably delivering a stream of fuel from the fuel conduit 4 into the mixing chamber 6, for example a metering pump which has an inlet 14 connectable to the fuel conduit 4 and an outlet 16 connected to the inlet 8 of the mixing chamber 6.

An air supply means, such as for example an air pump 18 is provided for delivering air into the mixing chamber 6. Between the air pump 18 and the mixing chamber 6 there is preferably connected a pressure regulating reducing valve 20, a shut-off valve 22, a heat exchanger 24 and a choked nozzle 26.

Connected to the outlet 10 of the mixing chamber is an element 27 for burning the fluid from the mixing chamber 6 and discharging resultant gasses. An oxygen sensing-signaling member 28 is positioned in the resultant gasses. Between the member 28 and the mixing chamber there preferably is one or more ceramic baffles 30,32 for stabilizing combustion and mixing the resultant gasses on opposed sides of a flame detector 34.

The oxygen sensing-signaling member is adapted to deliver a signal S-1 to a first controller 36 which is adapted to receive the signal S-1 and adjust the volume output of the metering pump 12 in response to S-1 for maintaining stoichiometric burning of the fluid mixture.

A measuring member 38 is connected to the metering pump 12 for measuring the volumetric output of the metering pump 12 and delivering a responsive signal S-2. The measuring member may consist of means for measuring the frequency of the strokes of a positive displacement metering pump.

A second controller 40 is adapted to receive signal S-2 and deliver a responsive signal S-3 for controlling the operation of the engine.

The heat exchanger 24 is preferably positioned between the reducing valve and the air nozzle and adapted to maintain the air temperature at a preselected range of about 170 degrees F. to about 190 degrees F., more preferably at about 180 degrees F. The element 27 for burning the fluids exiting the mixing chamber is preferably a glow plug.

The flame detector 34 is positioned in the resultant gasses and adapted to deliver a signal S-4 in response to detecting a flame. A third controller 42 is connected to the shut-off valve and the flame detector for receiving signal S-4 and closing the valve in response thereto.

Figure 2:
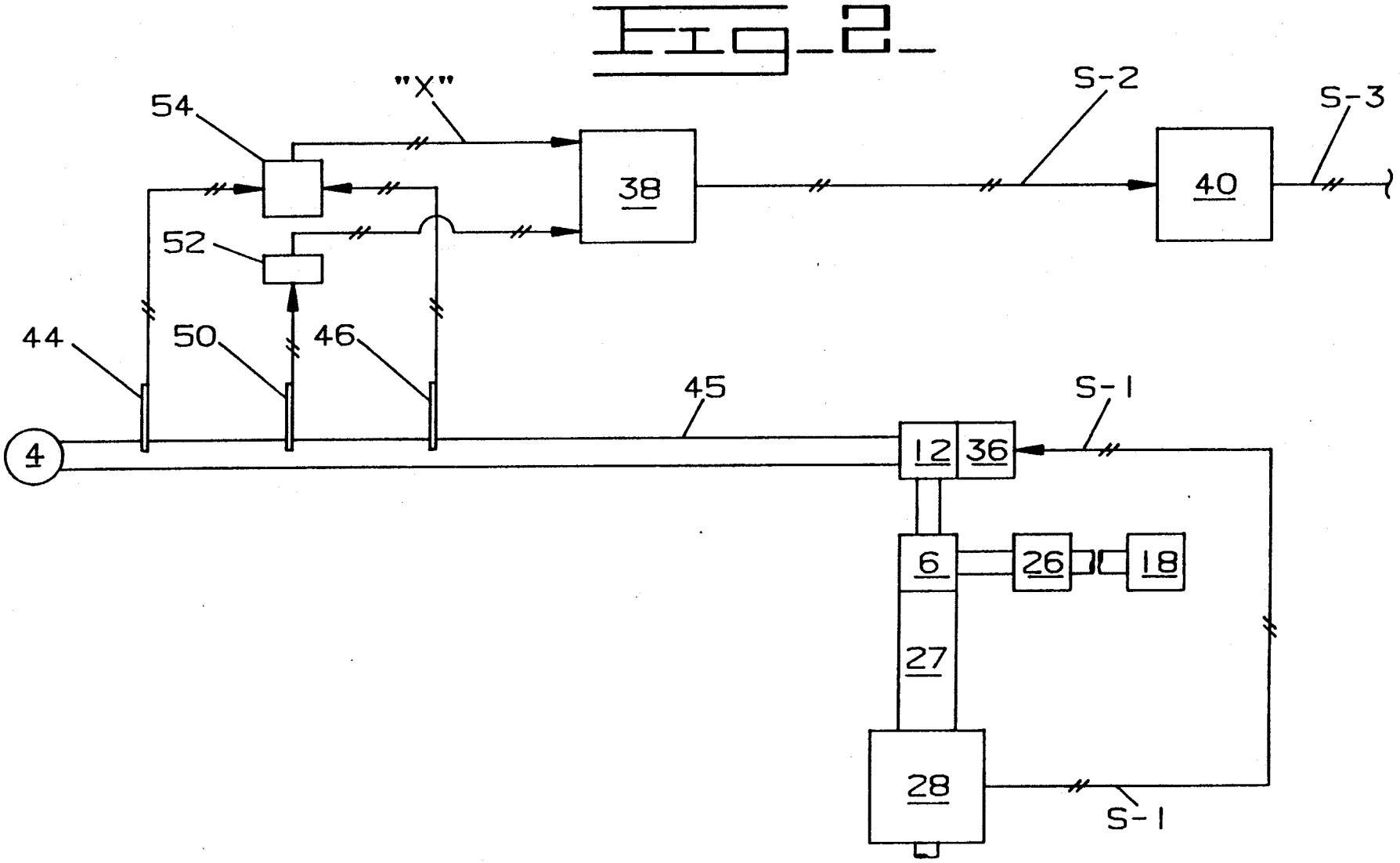
FIG. 2 is a diagrammatic view of another embodiment of the apparatus of this invention having a different fuel flow rate measuring apparatus and different fuel flow rate regulating apparatus.

Referring to FIG. 2, a different method for controlling and measuring the flow of fuel to mixing chamber 6, is employed. Fuel from the fuel gallery 4, enters sensing passage 7, which is of relatively small diameter compared with its length, passes through controllable needle valve 12 where it is mixed with a constant mass flow of air from air pump 18, via pressure regulating reducing valve 20, shut-off valve 22, heat exchanger 24 and choked nozzle 26 as shown in FIG. 1. The mixture then passes through the combustor/ flame sensor/ mixing section, and then passes by the oxygen sensor 28. The oxygen sensor 28 sends oxygen content signals to control 36, which delivers controlling signal S-1 to control valve 12.

The arrangement in FIG. 2 also uses a different means to accurately measure the volumetric flow rate (Q) of fuel which flows to the combustor which in this system is related to the volumetric energy content of the fuel. In this arrangement, a "time-of-flight" system is used to accurately determine the velocity (V) of flow in the sensing passage 7. Because the sensing passage cross sectional area (A) is constant, it is therefore possible to determine the volumetric flow rate (Q=AV).

The velocity in passage 7 is measured by means of thermocouples 44 and 46 and heater 50. Thermocouple 44 signals the temperature of fuel entering the sensing passage. Heater 50 is periodically energized to heat a small portion of fuel in passage 45 which is, subsequently, sensed by thermocouple 46. The difference in time between heating the fuel and sensing of the arrival of the heated fuel is related to the velocity of the fuel flowing in the sensing passage. This "time-of-flight" method of measuring fuel volumetric flow is used in instruments marketed by Thermalpulse, Inc. of Pittsburgh, Pa. under the name M-TEK and is capable of measuring very low flow rates with better than 0.1% precision.

Signal S-2 is thereafter sent to controller 40, and a signal S-3 is delivered responsive to the comparison to the engine controller (not shown).

Figure 3:
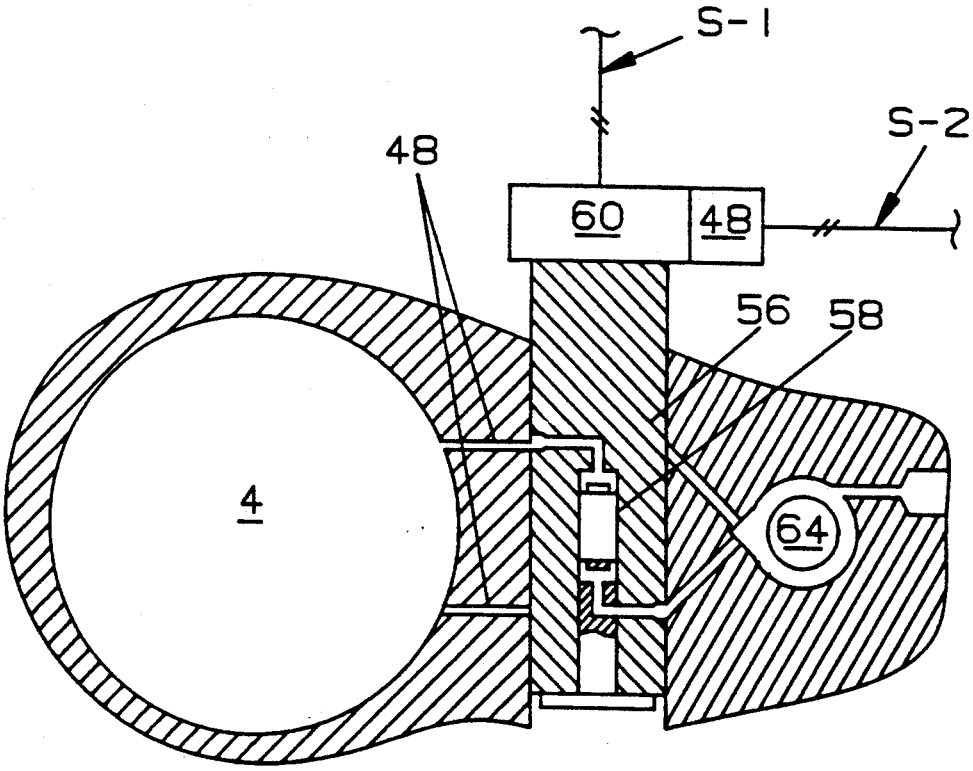
FIG. 3 is a diagrammatic view of another fuel flow rate regulating apparatus of this invention.

Referring to FIG. 3, another embodiment of the apparatus of this invention has a rotatable element 56 which has a port-controlled positive displacement shuttle piston 58 in communication with the sample stream 48 and a heating member 64 during rotation of the element 56. A motor 60 is connected to the rotatable element 56 and adapted to control the rotational speed of the rotatable element 56 in response to the signal S-1 from the oxygen sensing element 28.

A controller 48 senses the rotational speed of the rotatable element 56 and delivers a signal S-2 correlative to the volumetric flow rate of the sample stream 48. Other elements of the apparatus are like or similar to elements having the same number shown in FIGS. 1 and 2.

The flow rate measuring apparatus as shown in FIGS. 2 and 3 are known in the art and are commonly called time-of-flight and positive displacement shuttle piston, respectively.

Industrial Applicability

In the operation of the apparatus of this invention with a multi-fuel system, air to operate the device is delivered from the air pump 18. The air passes to the regulating apparatus 20 which maintains the pressure at exit at a preselected value in the range of about 30 psia to about 40 psia, more preferably at about 35 psia. The air then passes through the shut-off valve 22 and into the heat exchanger which preferably is jacketed by water from the engine block (not shown) for preferably maintaining the air at about 180 degrees F.

The air then passes through nozzle 26 which is preferably sized to maintain a pressure differential of about 2 to 1 and therefore functions at sonic velocity. As is well known, mass flow through a choked converging nozzle is dependent only on the absolute pressure and temperature of the air upstream of the orifice and the area of the orifice and is not affected by the barometric pressure at the exit of the orifice. Thus, it is possible to maintain a constant mass flow of air.

In the mixing chamber 6, entering fuel contacts the incoming air and air-assist atomization is obtained which facilitates burning or reaction of the fuel with the heating element 27. A first ceramic baffle 30 can be utilized as a flame holder and mixer. A flame detector 34 may optionally be used to assure the presence of flame and provide shutdown of the air supply in a case of flameout. It is not believed that such situation will arise since the heating element 27 acts as a pilot light, but if flame-out occurs, the apparatus can readily terminate the air supply. The gasses thereafter encounter ceramic baffles 32 which preferably are honeycomb type construction where additional gas mixing occurs and complete combustion is assured.

The gasses then pass over the oxygen sensing-signaling member 27 which preferably is formed of zirconium oxide. This member 27 preferably supplies a voltage if the products of combustion are rich or deficient of oxygen and provide essentially no voltage output if the products of combustion are lean or have an excess of oxygen. The first controller 36 receives the data of detection from the element 27 and responsively delivers a signal S-2 to the metering pump 12 for controlling fuel delivery at a rate sufficient to maintain stoichiometric conditions.

The second means 12 is preferably a variable volumetric flow rate pump. A preferred type is a positive displacement pump 12 in which the plunger has a constant stroke and is actuated by a solenoid device, as is known in the art. In the operation of the metering pump 12, the greater the frequency of operation the greater the volumetric flow rate of fuel. The frequency of the pump operation is thus sensed at stoichiometric conditions to determine the particular fuel being used by the engine, or more exactly, the volumetric energy content of the fuel which identifies the particular fuel.

The relative fuel flow rate of the apparatus 2 is proportional to the frequency of the metering pump 12 and can be plotted as a function of volumetric heat content of various fuels and will result in a curve of only slight deviations. Thus, by sensing the relative volumetric flow rate of the fuel in the subject apparatus 2, it is possible to provide a suitable signal to the electronic control unit of the engine (not shown) to indicate the volumetric heat content of the fuel being used. A number of programs can be placed in memory of the engine control unit to cover the range of fuels expected to be used.

Therefore the engine control unit can receive signal S-3 and responsively adjust the fuel rack and timing of the engine for the particular fuel being delivered.

Other aspects, objects and advantages of this invention can be obtained from a study of the drawings, the disclosure and the appended claims.

I claim:

1. Measuring-signaling apparatus for a multi-fuel system of an engine having a fuel conduit, comprising:

a mixing chamber having an inlet and an outlet;

first means for delivering a constant mass flow rate of air into the mixing chamber;

second means for controllably delivering a stream of fuel from the fuel conduit into the mixing chamber;

third means for burning the fluid from the mixing chamber and discharging resultant gasses;

fourth means for measuring the oxygen content of the resultant gasses and delivering a responsive signal S-1;

a first controller adapted to receive signal S-1 and automatically adjust the volume output of the second means in response to signal S-1 for maintaining stoichiometric burning of the fluid mixture;

fifth means for measuring the volumetric discharge of the second means and delivering a responsive signal S-2; and a second controller for receiving signal S-2 and delivering a responsive engine controlling signal S-3.

2. An apparatus, as set forth in claim 1, where the first means includes an air pump;

a pressure regulating apparatus connected to the air pump; and a choked nozzle connected to and between the pressure regulating apparatus and the mixing chamber.

3. An apparatus, as set forth in claim 2, including a heat exchanger positioned between the pressure regulating apparatus and the choked nozzle and being adapted to maintain the air temperature at a preselected temperature.

4. An apparatus, as set forth in claim 3, wherein the preselected temperature is in a range of about 170° to about 190°.

5. An apparatus, as set forth in claim 4, wherein the preselected temperature is maintained at about 180 degrees F.

6. An apparatus, as set forth in claim 1 including means for terminating the flow of air in response to a received signal.

7. An apparatus, as set forth in claim 1, wherein the third means includes a glow plug.

8. An apparatus, as set forth in claim 1, including means positioned in the resultant gasses discharging from the third means for mixing the gasses.

9. An apparatus, as set forth in claim 8, wherein the mixing means includes a ceramic baffle.

10. An apparatus, as set forth in claim 1, including a flame detector positioned in the resultant gasses and adapted to deliver a signal S-4 in response to detecting a flame.

11. An apparatus, as set forth in claim 10, including a valve positioned between the air pump and the mixing chamber; and a third controller connected to the flame detector and the valve for closing the valve in response to receiving signal S-4.

12. An apparatus, as set forth in claim 1, wherein the second means includes a flow rate controlling apparatus of the positive displacement variable frequency type.

13. An apparatus, as set forth in claim 1, wherein the fifth means includes a flow rate measuring apparatus of the time-of-flight type.

14. An apparatus, as set forth in claim 1, wherein the fifth means includes a flow rate measuring apparatus of the positive displacement shuttle piston type.

* * * * *